US005730116A

United States Patent [19]

Maiello et al.

[11] Patent Number: 5,730,116

[45] Date of Patent: Mar. 24, 1998

[54] NOX REDUCING COMBUSTOR TUBE INSERT APPARATUS

[75] Inventors: Dennis R. Maiello; Scott A. Willbanks; Phillip G. Brown, all of Fort Smith, Ark.

[73] Assignee: Rheem Manufacturing Company, New York, N.Y.

[21] Appl. No.: 681,322

[22] Filed: Jul. 22, 1996

[51] Int. Cl.[6] ..... F24H 3/02

[52] U.S. Cl. ..... 126/110 R; 126/116 R; 431/347; 122/44.2

[58] Field of Search ..... 126/110 R, 116 R; 431/347, 350; 122/44.2

[56] References Cited

U.S. PATENT DOCUMENTS

| | | | |
|---|---|---|---|
| 1,632,888 | 6/1927 | Davis et al. . | |
| 2,591,398 | 4/1952 | Brock | 110/97 |
| 3,165,143 | 1/1965 | Wilson, Sr. | 126/91 |
| 3,359,964 | 12/1967 | Wilson, Sr. | 126/91 |
| 4,044,796 | 8/1977 | Smick | 138/38 |
| 4,727,907 | 3/1988 | Duncan | 138/38 |
| 4,776,320 | 10/1988 | Ripka et al. | 126/99 |
| 4,781,578 | 11/1988 | Napier | 431/347 |
| 4,904,179 | 2/1990 | Drago et al. | 431/2 |
| 5,146,910 | 9/1992 | Grahl et al. | 126/110 R |
| 5,244,381 | 9/1993 | Cahlik | 431/171 |
| 5,333,597 | 8/1994 | Kirkpatrick et al. | 126/110 R |
| 5,370,529 | 12/1994 | Lu et al. | 431/353 |
| 5,472,339 | 12/1995 | Rakowski et al. | 431/171 |

*Primary Examiner*—Carroll B. Dority
*Attorney, Agent, or Firm*—Konneker & Smith

[57] ABSTRACT

A fuel-fired air heating furnace is provided with NOx reduction apparatus associated with a plurality of combustor tubes forming a portion of the furnace heat exchanger section. Inshot-type fuel burners are spaced apart from and face the open inlet ends of horizontal combustion sections of the combustor tubes. The NOx reduction apparatus includes a plurality of NOx reduction members formed from a metal rod material, and a mounting plate having a row of spaced apart pairs of mounting holes therein. Each NOx reduction member has an elongated, generally U-shaped configuration, with a closed inner end, an open outer end, and a spaced pair of corrugated leg portions extending between such inner and outer ends. The NOx reduction members are installed in a parallel relationship on the mounting plate, with their closed ends facing in the same direction, by resiliently deflecting the leg portions of each member toward each other, inserting the outer leg ends in one of the mounting plate hole pairs, and then releasing the legs. With the NOx reduction members secured to the mounting plate in this manner, they are simultaneously inserted closed ends first into their associated combustor tubes, and the mounting plate suitably supported adjacent the combustor tube inlets. The burners are then positioned to inject flames into the combustor tubes with the NOx reduction members positioned therein to operatively intercept the incoming burner flames.

16 Claims, 2 Drawing Sheets

NOX REDUCING COMBUSTOR TUBE INSERT APPARATUS

BACKGROUND OF THE INVENTION

The present invention generally relates to fuel-fired heating appliances, such as furnaces, water heaters and boilers and, in a preferred embodiment thereof, more particularly relates to apparatus and methods for reducing NOx emissions generated by the combustion systems in such appliances.

Nitrogen oxide (NOx) emissions in fuel-fired heating appliances, such as furnaces, water heaters and boilers, are undesirable pollutant products of the combustion process, and are formed when the combustion reaction takes place at high temperature conditions typically encountered in such heating appliances. One technique currently used to lower NOx emissions in fuel-fired heating appliances is to position a heat absorbing flame insert within the burner flame path for "quenching" purposes. The resulting lowered combustion flame temperature correspondingly creates desirably lowered NOx emission rates.

Conventionally configured flame insert structures that rely upon a flame temperature lowering "quenching" process to lower appliance NOx emissions are relatively easy and inexpensive to implement. However, these flame insert structures tend to have one or more of the following problems, limitations and disadvantages.

For example, many conventionally configured flame insert structures undesirably contact the combustor tubes along substantial areas of the inserts, thereby reducing the NOx reducing efficiency of the inserts. Additionally, the insert structures may provide satisfactory NOx reduction results when their associated heating appliance is being operated in a "full fire" mode, but provide too much quenching, and resulting flame temperature lowering, when the appliance is operated in a reduced firing rate mode.

Another problem associated with various conventionally configured flame insert structures is that when they thermally expand and contract within the combustor tube they can damage the interior surface of the combustor tube by scraping it as the insert portion contacting the interior tube surface moves along such surface as the insert structure thermally expands and contracts.

Moreover, while an individual flame insert structure of conventional configuration may be relatively easy and inexpensive to fabricate, the installation of a series of insert members in their associated series of combustor tubes tends to be tedious and time consuming since the insert structures must be installed one at a time in their associated combustor tubes. This typically entails the additional step, for each individual insert structure, of fastening the insert structure within its combustor tube to prevent an undesirable axial "migration" of the insert structure along the tube during the operation of the heating appliance.

As can be seen from the foregoing, it would be desirable to provide NOx reducing insert apparatus, for positioning in the combustor tubes of a fuel-fired heating appliance, that eliminated or at least substantially reduced the above mentioned problems, limitations and disadvantages commonly associated with conventionally configured NOx reducing insert structures of the type generally described above. It is accordingly an object of the present invention to provide such improved NOx reducing insert apparatus.

SUMMARY OF THE INVENTION

In carrying out principles of the present invention, in accordance with a preferred embodiment thereof, a fuel-fired heating appliance, representatively a fuel-fired air heating furnace is provided with a specially designed NOx emission reduction apparatus associated with its heat exchanger section.

The furnace includes a heat exchanger structure across which air to be heated may be flowed, the heat exchanger structure including a wall member having a spaced series of openings therein, and a spaced series of combustor tubes having open inlet end portions received in the wall member openings. Heat is selectively provided to the heat exchanger structure by a spaced plurality of fuel burners, representatively inshot-type burners, disposed in facing orientations with the open inlet end portions of the combustor tubes and operative to inject flames thereinto.

The NOx reduction apparatus includes a mounting member secured to the wall member adjacent the inlet portions of the combustor tubes, and a plurality of NOx reduction members. Each of the NOx reduction members has an elongated, generally U-shaped configuration with a closed inner end, an open outer end, and a pair of corrugated leg portions extending between the inner and outer ends of the NOx reduction member, each corrugated leg portion having an outer end section. Preferably, the NOx reduction members are formed from a metal rod material having a circular cross-section along its length.

The NOx reduction members longitudinally extend, closed inner ends first, into the combustor tube inlet end portions with the outer end sections of the NOx reduction members extending outwardly from the inlet end portions of the combustor tubes. Attachment means are provided for removably securing the outer end sections of the corrugated leg portions to the mounting member. The attachment of the outer end sections of the NOx reduction members to the mounting member advantageously permits all of the NOx reduction members to be simultaneously installed in their associated combustor tubes by simply moving the mounting member toward the wall member to insert the NOx reduction members into their associated combustor tubes, and then suitably securing the mounting member to the aforementioned furnace wall member.

According to a feature of the invention, the mounting member is a mounting plate having spaced apart pairs of mounting holes formed therein. The outer end sections of each pair of corrugated leg portions are removably received in one of the pairs of mounting holes. The mounting holes in each pair thereof are spaced apart from one another a distance causing the corrugated leg portions of their associated NOx reduction member to maintain a resilient bending force on the closed inner end of the NOx reduction member to press the outer end sections against the mounting plate and thereby facilitate the retention of the outer end sections in their associated mounting holes.

In a preferred embodiment of the furnace, the open inlet end portions of the combustor tubes are generally horizontally oriented, and each of the closed inner ends of the NOx reduction members slidably rests on a bottom interior side surface portion of its associated combustor tube inlet end portion. Thus, during thermal expansion and contraction of a given NOx reduction member, its closed inner end slides longitudinally along the bottom interior side surface of its associated combustor tube. Because of the circular cross section of each NOx reduction member, this sliding movement does not damage the interior side surfaces of the combustor tubes.

The NOx reduction members are easily and quickly installed on the mounting plate and, as previously mentioned, may be simultaneously installed within their associated combustor tubes by simply moving the mounting plate toward the open inlet ends of the combustor tubes and then securing the mounting plate to the furnace wall member. The shape of the NOx reduction members permit them to adequately quench the internal combustor tube flames which they intercept to thereby substantially reduce the NOx emission rate of the furnace during high fire operation thereof. Additionally, the shape of the NOx reduction members prevents them from undesirably over quenching the combustor tube flames when the furnace is operated in a lowered firing rate mode.

DETAILED DESCRIPTION

Figure 1:
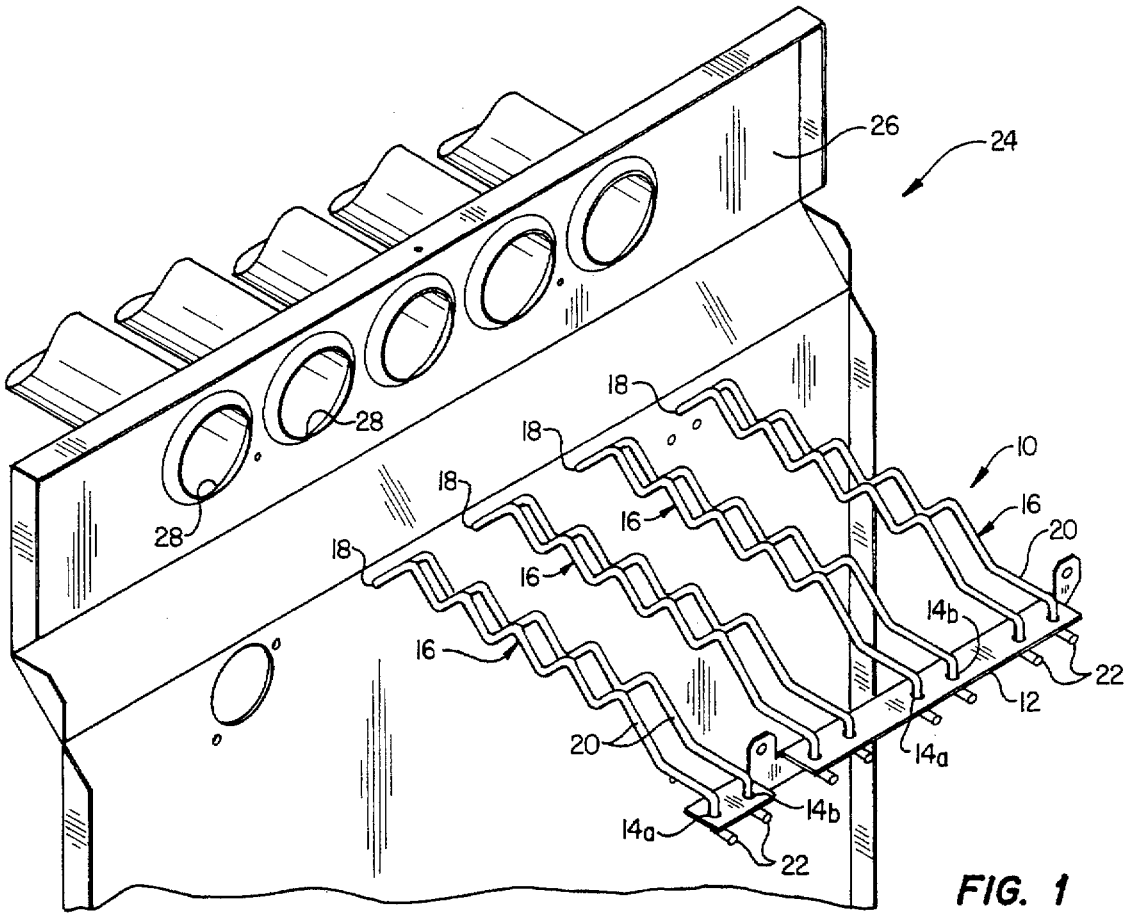
FIG. 1 is a partially exploded perspective view of a specially designed NOx reducing insert assembly embodying principles of the present invention and used in conjunction with the representatively illustrated fuel-fired furnace combustor tubes.
Figure 3:
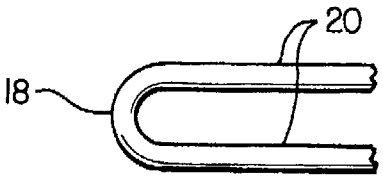
FIG. 3 is an elevational view of the inner end of the insert member taken along line 3—3 of FIG. 2.
Figure 2:
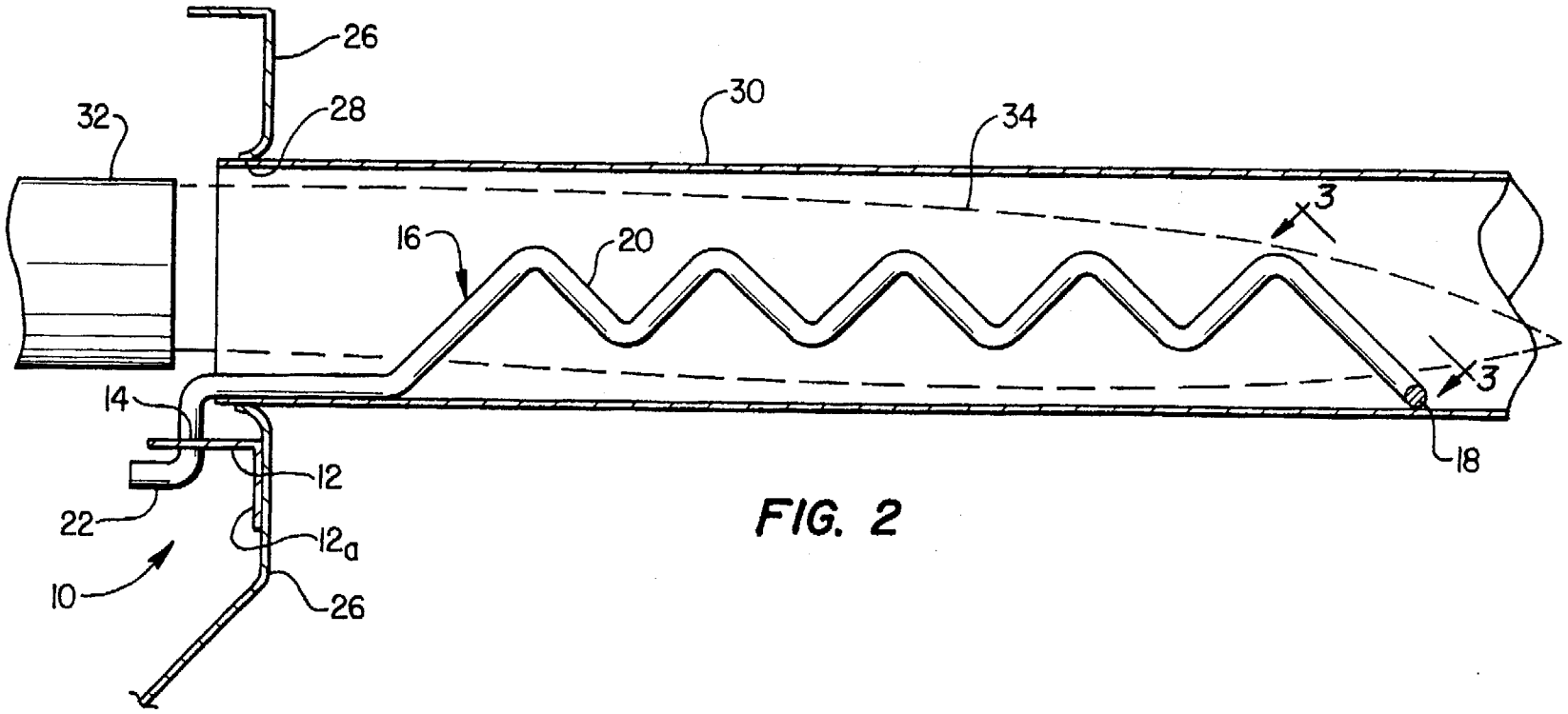
FIG. 2 is an enlarged scale laterally directed cross-sectional view through one of the combustor tubes with one of the individual NOx reducing insert members operatively disposed therein.

As illustrated in FIGS. 1–3, this invention provides a NOx reduction insert assembly 10 that includes an elongated rectangular mounting plate 12 with spaced pairs of holes 14*a*,14*b* therein, and a plurality of elongated NOx reduction insert members 16 formed from a suitable metal rod material preferably having a circular cross-section along its length. Each insert member 16 has an elongated, generally U-shaped configuration with a closed, rounded end 18 a laterally spaced generally parallel pair of corrugated leg portions 20 with generally L-shaped free end portions 22 disposed oppositely from the closed, rounded end 18.

In each of the insert members 16, prior to its attachment to the mounting plate 12, the lateral distance between the free leg ends 22 of the insert member are somewhat further apart than the distance between the mounting plate holes in each pair 14*a*, 14*b* thereof. Each insert member 16 may be quickly and removably installed on the mounting plate 12 simply by laterally deflecting the free leg ends 22 of the insert member 16 toward one another, inserting the free leg ,ends 22 into one of the mounting plate hole pairs 14*a*, 14*b* as shown, and then releasing the free leg ends 22, the laterally outwardly directed resilient force of the leg ends 22 serving to releasably retain them in their associated mounting plate hole pair 14*a*,14*b*.

The NOx reduction insert assembly 10 is utilized in conjunction with a gas fired furnace 24 having a center plate wall 26 with openings 28 therein that receive the inlet ends of a spaced series of heating combustor tubes 30 that define a portion of the heat exchanger section of the furnace. In a conventional manner, air to be heated and delivered to a conditioned space (not shown) is flowed externally across such heat exchanger section.

The insert assembly 10 may be easily and quickly installed on the furnace simply by holding the mounting plate 12 and moving it toward the wall 26 so that the insert members 16 simultaneously enter the inlet ends of the combustor tubes 30 as shown in FIG. 2. A downturned flange portion 12*a* of the mounting plate 12 is then secured to the center plate wall 26 as shown in FIG. 2.

A horizontally spaced series of inshot type gas burners 32 (one of which is visible in FIG. 2) are then mounted in front of the inlet ends of the combustor tubes 30 and are operated to inject flames 34, and resulting hot combustion gases, into the tubes 30. Each insert member 16 intercepts a portion of its associated burner flame 34 and acts reduce the NOx emissions associated with the combustion process within the tube 30.

In the manner described above, the installation of the insert members is easily achieved, with all of the insert members 16 being installed in the tubes 30 at the same time. The insert members are also quite easily and quickly installed in and removed from their associated mounting plate 12. Each insert member 16 is free to thermally expand in a longitudinal direction since their rounded ends 18 are not fixed, but can slide along the bottom side of their associated combustion tube 30. The round cross section of each member 16 permits the end 18 thereof to slide along the tube 30 without damaging it. As illustrated in FIG. 2, opposite end portions of each insert member 16 are configured and positioned to hold the operable corrugated portion of the member in a laterally central portion of the tube interior.

The corrugated, generally U-shaped configurations of the NOx reducing insert members 16 permits them to quench the flames 34 to a degree providing adequate NOx emission reduction during "high fire" operation of the furnace. The shape of the NOx reducing insert members 16, on the other hand, also prevents undesirable over quenching of the flames 34 when the furnace is operated in a lowered firing rate mode.

The foregoing detailed description is to be clearly understood as being given by way of illustration and example only, the spirit and scope of the present invention being limited solely by the appended claims.

What is claimed is:

1. A combustion system for a fuel-fired heating appliance, comprising:

a combustor tube having an open inlet end and a combustion section longitudinally extending inwardly therefrom along an axis;

a fuel burner operative to inject a flame into said open inlet end for flow through said combustion section of said combustor tube; and NOx reduction structure operative to reduce the NOx emission level of said heating appliance during operation thereof, said NOx reduction structure including:

a NOx reduction member having an elongated, generally U-shaped configuration with a closed inner end, an open outer end, and a spaced pair of corrugated leg portions extending between said inner and outer ends, and support means for supporting said NOx reduction member in an operative orientation in which it longitudinally extends, inner end first, into said combustion section of said combustor tube in the path of said flame.

2. The combustion system of claim 1 wherein said NOx reduction member is formed from a metal rod material.

3. The combustion system of claim 2 wherein:

said metal rod material has a generally circular cross-section along its length, said support means are connected to said outer end of said NOx reduction member and anchor it against appreciable axial movement relative to said combustion section of said combustor tube, and said inner end of said NOx reduction member slidably engages an interior surface portion of said combustion section of said combustor tube.

4. The combustion system of claim 3 wherein said support and said outer end of said NOx reduction member are located outside of said combustion section of said combustor tube.

5. The combustion system of claim 1 wherein:

said support means include a mounting member disposed externally of said combustor tube and having a spaced pair of mounting holes therein, and said corrugated leg portions of said NOx reduction member have outer end sections removably received in said mounting holes, said mounting holes being spaced apart a distance causing said corrugated leg portions to maintain a resilient bending force on said inner end of said NOx reduction member in a manner pressing said outer end sections against said mounting member and thereby facilitating the retention of said outer end sections in said mounting holes.

6. A NOx reduction structure for use in conjunction with a fuel-fired heating appliance having a spaced series of generally parallel combustor tube inlet end portions, said NOx reduction structure comprising:

a mounting member securable to the heating appliance externally of said combustor tube inlet end portions;

a plurality of NOx reduction members each having an elongated, generally U-shaped configuration with a closed inner end, an open outer end, and a pair of corrugated leg portions extending between said inner and outer ends of the NOx reduction member, each corrugated leg portion having an outer end section; and attachment means for removably securing said outer end sections of said corrugated leg portions to said mounting member in a manner positioning said NOx reduction members in a spaced, longitudinally parallel relationship permitting said NOx reduction members to be simultaneously inserted, closed inner ends first, into said combustor tube inlet end portions and said mounting member subsequently secured to the heating appliance.

7. The NOx reduction structure of claim 6 wherein each of said NOx reduction members is formed from a metal rod material.

8. The NOx reduction structure of claim 6 wherein:

said attachment means include spaced apart pairs of mounting holes formed in said mounting member, the outer end sections of each pair of corrugated leg portions are removably received in one of said pairs of mounting holes, and each pair of mounting holes are spaced apart from one another a distance causing the corrugated leg portions of their associated NOx reduction member to maintain a resilient bending force on the closed inner end of the NOx reduction member to press the outer end sections against the mounting member and thereby facilitate the retention of the outer end sections in their associated mounting holes.

9. The NOx reduction structure of claim 8 wherein:

said mounting member is a mounting plate, and each of said outer end sections has a first portion extending generally transversely to the length of its associated NOx reduction member and received in one of said mounting holes, and a second portion transverse to said first portion and extending outwardly away from its corrugated leg portion.

10. A fuel-fired air heating furnace comprising:

a heat exchanger structure across which air to be heated may be flowed, said heat exchanger structure including:

a wall member having a spaced series of openings therein, and a spaced series of combustor tubes having open inlet end portions received in said spaced series of openings in said wall member;

a spaced plurality of fuel burners disposed in facing orientations with said open inlet end portions of said combustor tubes and operative to inject flames thereinto; and NOx reduction apparatus including:

a mounting member secured to said wall member adjacent said inlet portions of said combustor tubes, a plurality of NOx reduction members each having an elongated, generally U-shaped configuration with a closed inner end, an open outer end, and a pair of corrugated leg portions extending between said inner and outer ends of the NOx reduction member, each corrugated leg portion having an outer end section, said NOx reduction members longitudinally extending, closed inner ends first, into said combustor tube inlet end portions with said outer end sections of said NOx reduction members extending outwardly from said inlet end portions, and attachment means for removably securing said outer end sections of said corrugated leg portions to said mounting member.

11. The fuel-fired air heating furnace of claim 10 wherein: each of said NOx reduction members is formed from a metal rod material.

12. The fuel-fired air heating furnace of claim 10 wherein:

said attachment means include spaced apart pairs of mounting holes formed in said mounting member, the outer end sections of each pair of corrugated leg portions are removably received in one of said pairs of mounting holes, and each pair of mounting holes are spaced apart from one another a distance causing the corrugated leg portions of their associated NOx reduction member to maintain a resilient bending force on the closed inner end of the NOx reduction member to press the outer end sections against the mounting member and thereby facilitate the retention of the outer end sections in their associated mounting holes.

13. The fuel-fired air heating furnace of claim 12 wherein:

said mounting member is a mounting plate, and each of said outer end sections has a first portion extending generally transversely to the length of its associated NOx reduction member and received in one of said mounting holes, and a second portion transverse to said first portion and extending outwardly away from its corrugated leg portion.

14. The fuel-fired air heating furnace of claim 10 wherein:

said open inlet end portions of said combustor tubes are generally horizontally oriented, each of said NOx reduction members is formed from a metal rod material having a circular cross-section along its length, and each of said closed inner ends of said NOx reduction members slidably rests on a bottom interior side surface portion of its associated combustor tube inlet end portion.

15. The fuel-fired air heating furnace of claim 10 wherein: said plurality of fuel burners are inshot-type fuel burners.

16. The fuel-fired air heating furnace of claim 10 wherein:

the corrugations in each associated pair of corrugated leg portions of said NOx reduction members lie in spaced apart, generally parallel planes.

* * * * *